United States Patent [19]

Benoit

[11] 4,319,309

[45] Mar. 9, 1982

[54] SAFETY LIGHT

[75] Inventor: Raymond A. Benoit, Vernon, France

[73] Assignee: Wonder Corporation of America, Conn.

[21] Appl. No.: 91,542

[22] Filed: Nov. 5, 1979

[51] Int. Cl.[3] ..... F21L 15/14

[52] U.S. Cl. ..... 362/108; 362/186; 362/191; 362/200

[58] Field of Search ..... 362/108, 186, 191, 200

[56] References Cited

U.S. PATENT DOCUMENTS 3,112,889 12/1963 Marmo et al. ..... 362/103

3,321,617 5/1967 Santana ..... 362/103

*Primary Examiner*—Stephen J. Lechert, Jr.

*Attorney, Agent, or Firm*—Stephen E. Feldman; Marvin Feldman

[57] ABSTRACT

A safety light adapted to be carried by a person comprises a battery casing. A lens casing is supported on the battery casing. A strap having two ends is slidably affixed to the battery casing for attaching said safety light to a person. A closure device is associated with a strap for securing the strap to form a band. The closure device includes a closure element having a base and two opposing side walls extending upward from two sides of the base. A lock device is rotably received between the side walls for pressing two overlapping portions of the strap against the base. In addition, the lens casing has a substantially rectangular box-like shape. The bottom of the lens casing is open to receive a light producing element. A base wall extends around the lower portion of the rectangular box. Two substantially identically shaped lens devices are affixed to the base wall and comprise the majority of the remainder of the lens casing.

8 Claims, 8 Drawing Figures

FIG. 1
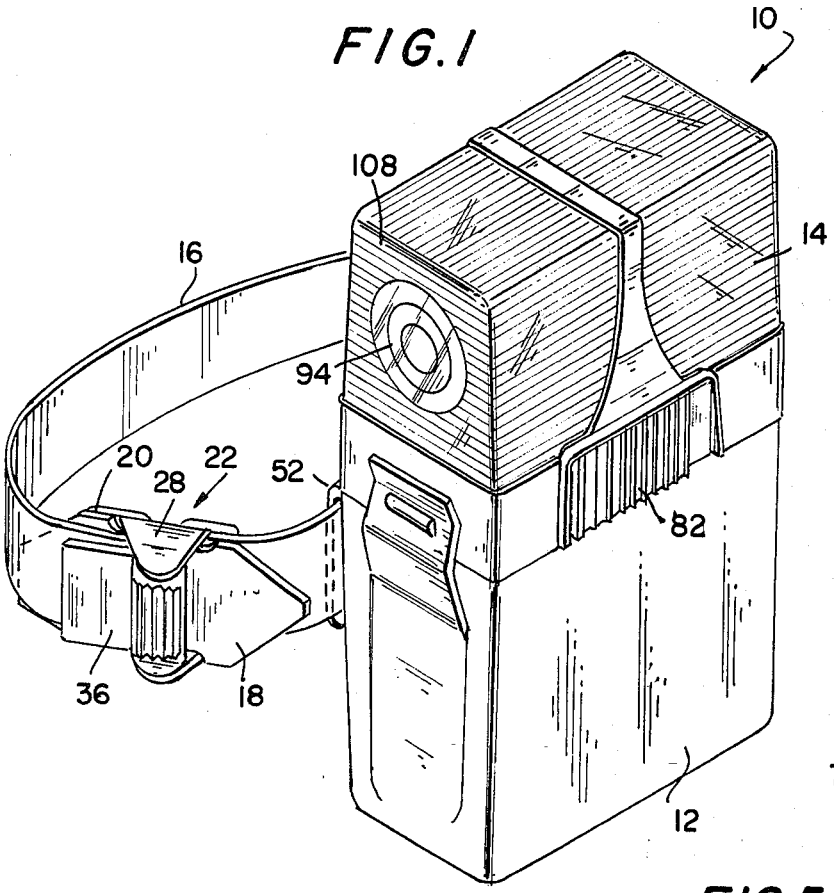
FIG. 4
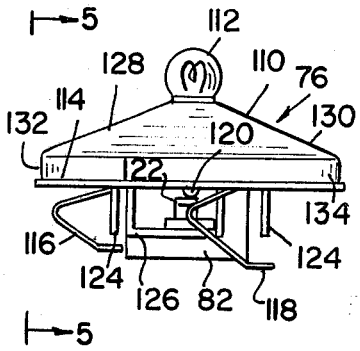
FIG. 5
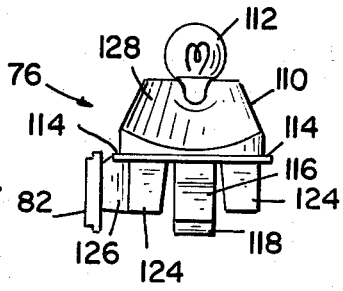
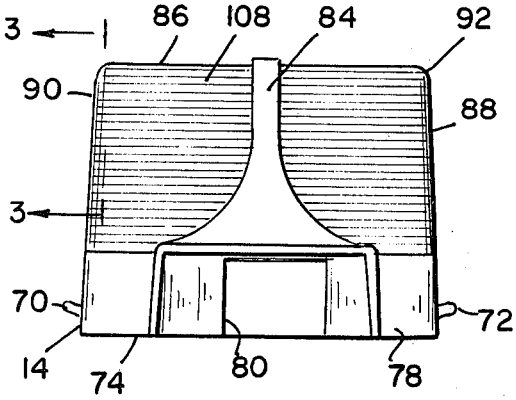
FIG. 2
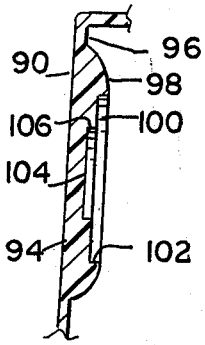
FIG. 3

SAFETY LIGHT

BACKGROUND OF THE INVENTION

While the present invention is subject to a wide range of applications, it is especially related to safety lights adapted to be carried by a person and will be particularly described in that connection.

With the current upsurge in bicycle usage, there has been a problem for operators of motor vehicles to see the moving bicycle during nighttime operation. Safety lamps have been known which can be carried on a limb of a body, such as an arm or leg, such as to allow the recognition of the bicycle during its movement. Several examples of this type of device are provided in U.S. Pat. No. 1,594,510 to Saks which provides for example, "lamps of a type suitable to be carried upon a person's arm, for the purpose of enabling him to see and be readily seen during the night". U.S. Pat. No. 4,112,482 to Powell is a safety belt suitable for many purposes.

The above mentioned patents have found to be lacking in several areas. A strap device for affixing the safety light to a limb of a person has not been available which can easily be adjusted to accommodate different sized limbs such as for large or small people or for legs or arms. Also, a suitable closure device which does not create any discomfort to the user and yet can provide easy adjustment as well as retaining the ends of the strap to form a band irrespective of whether the light is mounted on the person or not, or how quickly the light is removed from the limb on which it is carried. In addition, the safety lights of the prior art did not teach a single light source providing two beams of light of different color directed in opposite directions as well as two diffused areas of light for improving the opportunity of recognizing the moving bicycle. Further, the prior art devices did not provide a very compact, relatively easy to manufacture, aesthetically looking safety light.

It is an object of the present invention to provide a safety light which obviates some or all of the above-mentioned deficiencies.

It is a further object of the present invention to provide a safety light with a strap having a closure device which is comfortable and easy to operate.

It is a still further object of the present invention to provide a safety light which can be easily recognized.

It is a yet further object of the present invention to provide a safety light which is compact and relatively inexpensive to manufacture.

SUMMARY OF THE INVENTION

Accordingly, there has been provided a safety light adapted to be carried by a person comprising a battery casing. A lens casing is supported on the battery casing. A strap having two ends is slidably affixed to the battery casing for attaching said safety light to a person. A closure device is associated with a strap for securing the strap to form a band. The closure device includes a closure element having a base and two opposing side walls extending upward from two sides of the base. A lock device is rotably received between the side walls for pressing two overlapping portions of the strap against the base. In addition, the lens casing has a substantially rectangular box-like shape. The bottom of the lens casing is open to receive a light producing element. A base wall extends around the lower portion of the rectangular box. Two substantially identically shaped lens devices are affixed to the base wall and comprise the majority of the remainder of the lens casing.

For a better understanding of the present invention, together with other and further objects thereof, reference is made to the following description, taken in connection with the accompanying drawings, while its scope will be pointed out in the appended claims.

BRIEF DESCRIPTION OF THE DRAWINGS

FIG. 1 is a perspective view of a safety light in accordance with the invention;

FIG. 2 is a side view of a lens casing in accordance with the present invention;

FIG. 3 is a view through 3—3 of FIG. 2;

FIG. 4 is a side view of a bulb and switch holder;

FIG. 5 is a view through 5—5 of the FIG. 4;

DESCRIPTION OF THE PREFERRED EMBODIMENT

Figure 6:
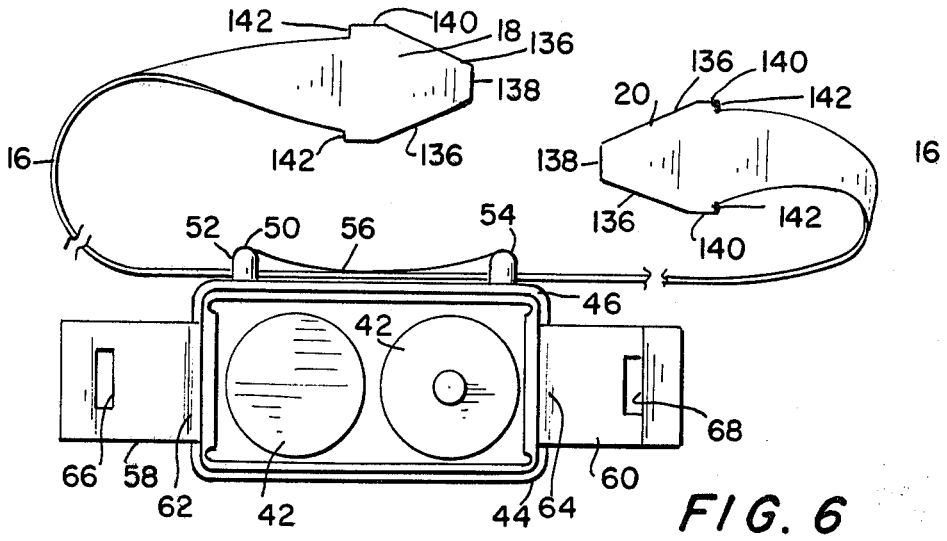
FIG. 6 is a top view of the battery casing.
Figure 7:
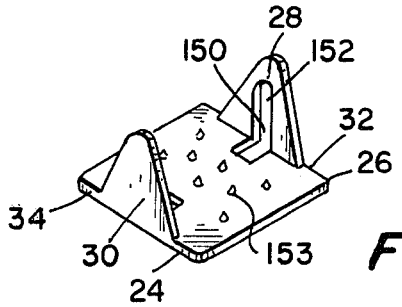
FIG. 7 is a perspective view of the base of a closure device.

A safety light 10 adapted to be carried by a person comprises a battery casing 12. A lens casing 14 is supported on the battery casing 12. A strap 16 having two ends 18 and 20 is slidably affixed to the battery casing 12 for attaching the safety light 10 to a person. A closure device 22 is associated with the strap for securing the strap to form a band. The closure device 22 includes a closure element 24 having a base 26 and two opposing side walls 28 and 30 extending upward from two sides 32 and 34 of the base 26. A lock device 36 is rotably received between the side walls 28 and 30 for pressing two overlapping portions of the strap against the base.

The safety light 10 includes a battery casing 12. The battery casing as best seen in FIGS. 1 and 6, has a substantially rectangular open top 40. Two batteries 42 may be placed into the battery through the top and they rest on a metal conductor (not shown) which forms an electrical contact between the two batteries. A ridge 44 and 46 extends around the top of the casing and provides a support for the lens casing which is mounted onto the battery casing and rests on these two ridges. A bracket 50 including two grooves 52 and 54 is affixed to the rear surface of the battery casing and further includes a curved member 56 which may rest against the limb of the person carrying the light. A latch device 58 and 60 is attached along a bottom edge 62 and 64 to the battery casing. Thus, the two latch devices are free to move so that openings 66 and 68 can be snapped onto protrusions 70 and 72 which are located on the lens casing 14 as will be further described. The battery casing is preferably formed of a durable plastic material in a moulding process. However, it is within the scope of the present invention to form the battery casing of any desirable material which is constructed in accordance with its manufacturing requirements.

The lens casing 14 as best seen in FIGS. 1 and 2, has a substantially rectangular box-like shape. The base 74 of the lens casing is open in order to receive a light producing device 76 as will be further described. A base wall 78 extends around the lower portion of the rectangular box and has two protrusions 70 and 72 extending therefrom, as previously explained. A substantially square opening 80 is provided in the base wall for receiving the switch button 82 carried on the light producing device 76, as will be further described. A central dividing wall 84 extends from the base wall 78 upward to divide the top portion of the lens casing into two parts and to support the lens elements 86 and 88 as will be further described. Each of the lens casing is fit between the central dividing wall 84 and the top of the base wall 78 and thus, make up the majority of the remainder of the lens casing other than the base wall. The lens elements may be affixed to the lens casing in any desired manner, such as for example, by glue. Each of the lens elements may be a different color, such as for example, lens 86 may be of a clear translucent material, while lens 88 may have a color, such as for example, red or amber. On the end face 90 and 92 of each lens element there may be provided a freznel-type lens 94 which is comprised of different shaped circular rings. As shown in FIG. 3, the cross-section through the diameter of the circular lens 94 includes an outer flat ring 96. Then a curved ring 98 is connected to the ring 96 and extends away from the end face 90. A third ring 100 is flat and is provided closer to the end face 90 whereby a wall 102 is formed. Finally, a central circular surface 104 is located closer to the face 90 whereby a second wall 106 is formed. The lens 94 which is located on both end face 90 and 92, focuses the light as it leaves the lens casing. Although a particular configuration has been illustrated and described, it is within the scope of the present invention to provide the circular lens with a different shape, as desired. In addition, each of the lens elements 86 and 88 may be smooth on the outside and contain a series of parallel grooves 108 which act to diffuse the light to that the safety light can be seen from many directions, as will be further described.

A light producing device 76 as best seen in FIGS. 4 and 5, consist of a moulded bulb retainer 110 for holding a light bulb 112. Along the edge of the bulb retainer is a support ridge 114 for contacting a ridge (not shown) within the lens casing to support the bulb retainer when the safety light is assembled. Two metal clips 116 and 118 are affixed to the bottom of the bulb retainer for contacting the batteries located in the battery casing 12. The clip 116 has a portion which contacts the outer edge of the bulb 112 (not shown), while the clip 118 contacts the tip 120 of the bulb. A switch 82 includes a finger portion 122 which acts to separate the clip 118 from the tip of the bulb 120 and thereby turn the light off. Base extensions 124 extend from the bottom of the bulb retainer 110 and rest on the batteries when the light is assembled. A switch support 126 protrudes from the bottom of the bulb retainer and fits within the square opening 80 in the base wall 78 of the lens casing.

The bulb retainer 110 has two substantially symmetrical top faces 128 and 130. Each has a sloping curvature extending downward towards the front and rear sides 132 and 134 respectively. When the light producing device 76 is assembled on the lens casing, the bulb 112 is aligned with the circular lens 94 and the sloping curvature allows the light to shine on the entire end faces 90 and 92.

The strap 16 which is used to attach the safety light to a person, includes two ends 18 and 20 which have a wider width than the remaining portion of the strap. Referring to FIG. 6, the ends of the strap are illustrated without the closure element 24 and the lock device 36. In the preferred embodiment, the ends 18 and 20 are substantially detached and have converging side walls 136 which meet at an end face 138 on one side and at parallel end wall 140 at the other end. The end walls 140 are also parallel to the edges of the strap 16 and a perpendicular edge 142 is thereby formed. These strap ends 18 and 20 make up part of the closure device 22 as will be further described. The actual construction of the strap may be a vinyl material backed by foam rubber. On the other side of the foam rubber, a web of any desirable material such as nylon may be attached thereto. Thus, the strap has the advantage of being very attractive on the side which is visible when the light is attached to a person, while the foam backing gives it some body without affecting the flexibility of the strap. Finally, the woven backing on the foam, gives strength to the foam backing and at the same time provides some friction to prevent the light from sliding when it is attached to a person. It is within the scope of the present invention to form the strap of any other desired material or combination of materials such as for example, leather. In addition, the length of the strap can be as long as described whereby it may be used for people of different sized limbs and also a mold both for arms or legs.

The closure device 22 is associated with the strap for securing the strap to form a band as shown in FIG. 1 The closure device 22 includes a closure element 24 as best seen in FIG. 6. The closure element has a base 26 and two opposing side walls 28 and 20 extending upward from two sides 32 and 34 of the base. The side walls 28 and 30 are substantially triangular in shape and include a slot 150 having a curved top 152 for receiving the lock device 36 as will be further described. Each of the side walls 28 and 30 have a slot 150. Extending from the base 26 of the closure element 24, is a series of substantially conical protrusions 154 which coact with the strap as will be further described.

Figure 8:
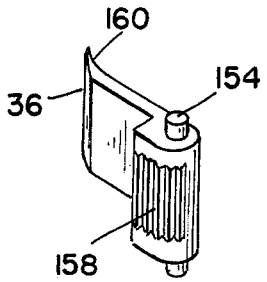
FIG. 8 is a perspective view of a portion of the closure device.

A lock device 36 as best illustrated in FIG. 1 and FIG. 8, includes tubular extensions 154 and 156 extending from the sides of the lock device and sized to be received within the slots 150 of the closure element 24. In addition, if desired circular flanges 156 and 158 surround the tubular extensions and may act against the side walls 28 and 30 as a bearing surface, if required. Along the bottom surface of the closure device is a series of teeth 158 for contacting the straps as will be further described. An extension element 160 is connected to the lock device for moving it between an open and closed position.

When the strap is assembled together with the closure device 22, the first and second ends are inserted between the teeth of the lock device 36 and the space 26 of the closure element 24. In this position, one of the straps overlaps the other strap, and the closure device maintains the strap in the form of a band, irrespective of whether the lock device is opened or closed. The reason for the strap not releasing from the closure element is that the width of the ends 18 and 20, specifically at the parallel end walls 140 is greater than the width between the side walls 28 and 30 and therefore, the ends of the strap cannot easily come out from the closure device.

In order to more fully appreciate the present invention, the following description is of an assembled safety light. Two batteries are placed in the battery casing 12. Then, the light producing device 76 is inserted into the lens casing 14. The lens casing is then mounted onto the battery casing and the latch devices 58 and 60 are snapped onto the protrusions 70 and 72. At this point the safety light is ready to operate by simply moving the switch 82 from one position to another position and thereby turning the light on or off. The strap 16 is passed through the grooves 52 and 54 of the bracket 50 and the ends 18 and 20 extend through the closure device 22. Note that the base of the closure device is flat with protrusions 153 extending therefrom to grab the back surface of the strap. When the strap is held by the closure device, the lock device 36 presses the two overlapping portions of the strap against the protrusions on the base. Since the ends of the strap have a width which is wider than the width of the rest of the strap, the strap is prevented from pulling out from the closure. Thus, the strap is always maintained in the shape of a band so that it can easily be attached to a person.

In using the safety light, the strap may be placed around an arm or a leg of a person and the top end such as 18 may be pulled when the lock device is opened so as to tighten the band around the limb of the person. After it is at a desired tension, the lock device can be closed with the teeth 158 pressing against the top part of the strap whereby the two overlapping straps are pressed and the bottom of the lower strap is frictionally engaging the protrusions. The bracket 50 rests confortably against the limb of the person because of its curved member 56. The closure device 22 has a flat bottom surface so as not to cause any discomfort to the wearer. Also, in use the clear lens will most likely face towards the front of the person, while the red or amber lens will face to the rear. Also, the switch would most likely face out from the person so that it can easily be reached to turn on or off.

Accordingly, there has been provided a safety light which is easily attached to a person, comfortable to wear, attractive and relatively inexpensive to manufacture.

While there has been described what is at present considered to be the preferred embodiment of the invention, it will be obvious to those skilled in the art that various changes and modifications may be made therein without departing from the invention, and it is, therefore, aimed in the appended claims to cover all such changes and modifications as fall within the true spirit and scope of the invention.

I claim:

1. A safety light adapted to be carried by a person comprising:

a battery casing;

a lens casing supported on said battery casing, said lens casing including at least one lens means disposed in a wall of said lens casing, and a internal light producing means;

a strap having two ends slidably affixed to said battery casing for attaching said safety light to a person, closure means associated with said strap for securing said strap to form a band;

said closure means including a closure element having a base and two opposing side walls, said side walls extending upward from the sides of said base; the width of said strap being substantially the width between said side walls, said closure means further including the ends of said strap having a second width wider than said first width whereby the ends of said strap are prevented from pulling out from said closure means, and lock means rotatably received between said side walls for pressing two overlapping portions of said strap against said base.

2. The safety light as defined in claim 1 further characterized in that said lock means includes a surface having teeth for contacting one of the overlapping portions of the straps to frictionally prevent them from moving in the locked position.

3. The safety light as defined in claim 2 further characterized in that an extension is connected to said lock means for moving the lock means between the open and closed position.

4. A safety light adapted to be carried by a person comprising:

a battery casing;

strap means carried by said casing for attaching the safety light to a person;

a lens casing supported and removably affixed to said battery casing;

said lens casing being a substantially rectangular box-like shape, the bottom of said lens casing being open to receive a light producing means, a base wall extending around the lower portion of the rectangular box, and two substantially identically shaped lens means, said two lens means being affixed to said base wall and comprising the majority of the remainder of said lens casing, each of said lens means being translucent, said two lens means being of different colors from each other.

5. The safety light as defined in claim 4 wherein each of said lens means includes a circular lens on opposing walls of said box whereby two different colors of light are focused out of said safety light.

6. The safety light as defined in claim 5 wherein the remaining surface of each of said lens means diffuses the colored light emanating therefrom.

7. The safety light as defined in claim 6 wherein switch means for turning the safety light on or off is located in said base wall.

8. The safety light as defined in claim 7 wherein latch means are provided for fixing said lens casing to said battery casing.

* * * * *